United States Patent [19]

Koslowski et al.

[11] Patent Number: 4,926,531

[45] Date of Patent: May 22, 1990

[54] APPARATUS FOR GIVING PROTECTION FROM DRAFT AND DUST AT A WINDING MACHINE

[75] Inventors: Gerhard Koslowski, Uzwil; Manfred Bollen, Oberuzwil, both of Switzerland

[73] Assignee: Benninger AG, Uzwil, Switzerland

[21] Appl. No.: 299,546

[22] Filed: Jan. 11, 1989

[30] Foreign Application Priority Data

Jan. 22, 1988 [CH] Switzerland ..... 224/88

[51] Int. Cl.[5] ..... D02H 11/00

[52] U.S. Cl. ..... 28/173; 28/172; 15/301

[58] Field of Search ..... 28/172, 222, 173; 15/301; 57/300; 242/35.5 R

[56] References Cited

U.S. PATENT DOCUMENTS

| | | | |
|---|---|---|---|
| 2,125,774 | 8/1938 | Eaddy | 28/173 |
| 3,018,603 | 1/1962 | Rutz et al. | 57/304 |
| 3,667,093 | 6/1972 | Culpepper, Jr. | 28/173 |
| 4,088,157 | 9/1978 | Chen et al. | 139/1 |
| 4,315,529 | 2/1982 | Baumann | 139/1 |
| 4,594,845 | 6/1986 | Matsui | 242/35.5 |

FOREIGN PATENT DOCUMENTS 1073973 1/1960 Fed. Rep. of Germany .

*Primary Examiner*—Werner H. Schroeder
*Assistant Examiner*—Bradley K. DeSandro
*Attorney, Agent, or Firm*—Shoemaker and Mattare, Ltd.

[57] ABSTRACT

The protective apparatus for a winding machine is formed by a support construction comprising pillars and a transverse support member. The support construction is arranged in a portal-like fashion over the winding machine, wall portions in the form of swing doors and an anti-draft plate filling the intermediate space. The wall portions are secured to the support construction and can preferably be actuated automatically by drive means.

12 Claims, 2 Drawing Sheets

APPARATUS FOR GIVING PROTECTION FROM DRAFT AND DUST AT A WINDING MACHINE

FIELD OF THE INVENTION

The invention relates to an apparatus for giving protection from draft and dust at a winding machine, in particular a warping or beaming machine comprising a beam for winding on an array of yarns which are supplied from a bobbin creel.

Apparatuses of that kind serve to protect the operators of the winding machine from the effects of air draft and the formation of dust. The high yarn draw-off speeds in the region of 1000 m/min or more can result in the production of strong air currents which are directed from the bobbin creel towards the winding machine. In that situation, depending on the material to be processed, dust is also produced, so that the conditions which occur can be unpleasant from the point of view of the operating personnel and may in part be damaging to health.

DESCRIPTION OF THE PRIOR ART

It is already known for a draft-proofing plate to be arranged above the winding machine, being fixed directly to the frame structure of the machine. Although that draft-proofing plate prevents the operator behind the machine from being directly exposed to the dust-bearing draft, the draft-proofing plate does not however prevent turbulent edge currents from occurring around the machine. In particular particles of dust are swirled into the area laterally of and over the draft-proofing plate so that the quality of the air available for respiration can be seriously impaired.

SUMMARY OF THE INVENTION

An object of the present invention is therefore to provide a protective apparatus of the kind set forth in the opening part of this specification, by means of which the operating personnel can be afforded optimum protection from air currents and the formation of dust, at the winding machine.

The apparatus is also to be operator-friendly and is not to impair the operating and service operations to be carried out at the machine. Finally the protective apparatus is also to enhance operational safety at the machine.

In accordance with the invention that object is achieved in that arranged over the winding machine and substantially parallel to the axis of the beam is a portal-like support construction which extends in respect of width and height beyond the machine and on which are disposed fixed and/or movable wall portions which substantially close off the space between the support construction and the winding machine.

The portal-like configuration of the support construction gives the advantage that no supports or the like for mounting the wall portions have to be arranged at the machine itself. In addition the support construction permits a relatively large area around the machine to be covered. In that arrangement the wall portions may be adapted to the outside contour of the machine in such a way that there are only negligible spaces between the source of draft or development of dust and the space in which the operating personnel is to be found. In that connection the support construction may readily be of such a size that it fills the entire cross-section of the room or space in question and in that way forms a partitioning wall into which the winding machine is integrated.

A pivotable anti-draft plate may also be secured to the support construction in a particularly simple fashion without the anti-draft plate having to be structurally connected to the winding machine or to the floor. In the same way, doors may be secured to the support construction, the doors permitting a person to pass at any time into the machine room housing the creel.

A particularly high degree of operational safety and operator comfort is achieved if the anti-draft plate and/or the doors are actuable by drive means which can be activated in dependence on the operating condition of the winding machine in such a way that they are movable into a closed position when the machine starts and into an open position when the machine stops. In that way, the draw-in region of the array of yarns is freely accessible when the machine is stationary while it is closed off by the anti-draft plate when the machine is running. At the same time, the doors open automatically when the machine is stationary as in that case it is in any event necessary for an operator to go into the rear machine room with the bobbin creel. When the machine starts the door also closes automatically so that an approximately hermetic sealing action is always ensured when the machine is running. In addition a sensor device may be put in the region of the door, for activating the drive means for the door in such a way that it is movable into the open position when the door is approached. The sensor device may be for example a photoelectric cell which is disposed at the support construction. Instead of the photoelectric cell however it would also be possible to envisage using mechanical, electronic or ultrasonic sensors.

In a particularly advantageous configuration the door is a transparent or opaque swing door which makes it possible to look through the door from the operating position and which does not adversely affect the conditions in regard to light. Depending on the respective type of winding machine it may be advantageous for a swing door to be arranged on both sides of the winding machine.

The emission of dust in the machine room can be reduced in a particularly simple fashion if an extractor hood which opens towards the winding machine and which is connected to a suction apparatus for sucking away dust is arranged over the support construction on the yarn supply side. Sucking away dust in that way prevents the dust from being able to settle in the machine room and on the machines. On the contrary, the arrangement of the extractor hood makes use of the air current which is caused by the group of yarns and which transports the particles of dust and dirt towards the winding machine or towards the wall portions on the support construction. The suction effect which occurs at the extractor hood deflects the current of air upwardly before the dust can settle.

That air flow configuration can be further promoted by virtue of the fact that on the yarn supply side, to avoid turbulent air currents, the winding machine is cowled with guide covers. The guide covers are preferably inclined towards the ground in opposite relationship to the direction of flow of the currents, thus resulting in a flow which is directed towards the extractor hood and which is laminar as possible.

DESCRIPTION OF THE DRAWINGS

Further features and advantages of the invention will be apparent from the description of a specific embodiment illustrated in the accompanying drawings in which.

DESCRIPTION OF A PREFERRED EMBODIMENT

Figure 1:
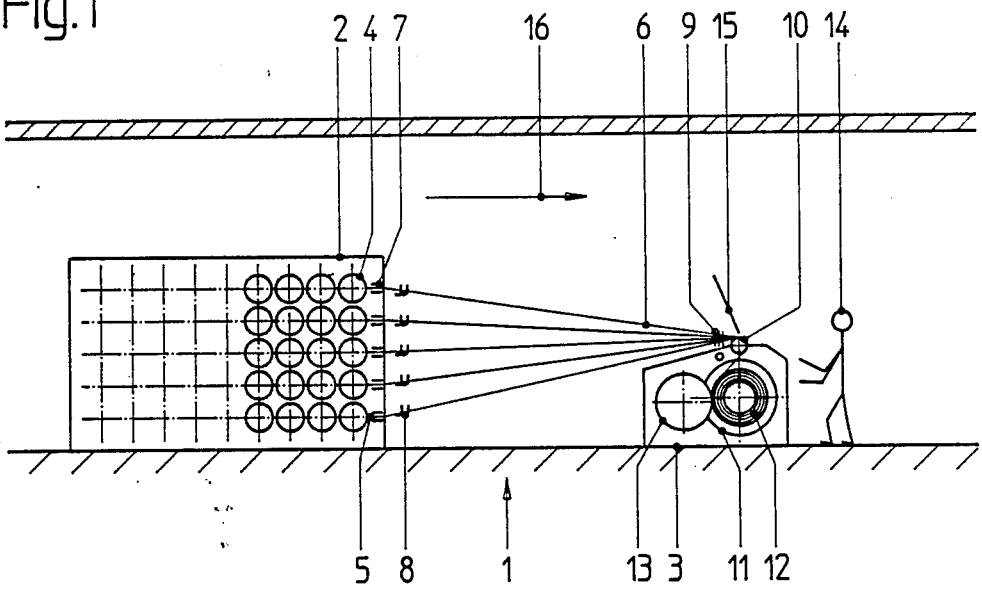
FIG. 1 is a greatly simplified view in cross-section through a winding installation in accordance with the state of the art.

FIG. 1 is a view in cross-section of a winding installation 1, such as for example a warping installation, comprising a bobbin creel 2 and a warping machine 3. The yarns 5 are drawn from the bobbins 4 at the bobbin creel 2 in per se known manner and supplied to the machine 3 in the form of an array of yarns 6. In that respect the individual yarns 5 each pass through a respective yarn tensioner 7 for producing a constant yarn tension and a yarn monitor 8 for monitoring the presence of the yarns.

The yarns 6 are passed in an ordered fashion in the comb 9 of the machine 3, over the measuring roller 10 and wound on to the warping beam 11. The winding 12 produced in that way is continuously pressed by a pressure roller 13.

As already mentioned, the array of yarns 6 produces a current of air in the direction indicated by the arrow 16 towards the warping machine 3 and thus also towards an operator 14 standing at the machine 3. FIG. 1 shows the above-mentioned anti-draft plate 15 over the warping machine, as was hitherto generally conventional practice. It is already apparent from the drawing that such an anti-draft plate affords only very limited protection for the operator.

Figure 2:
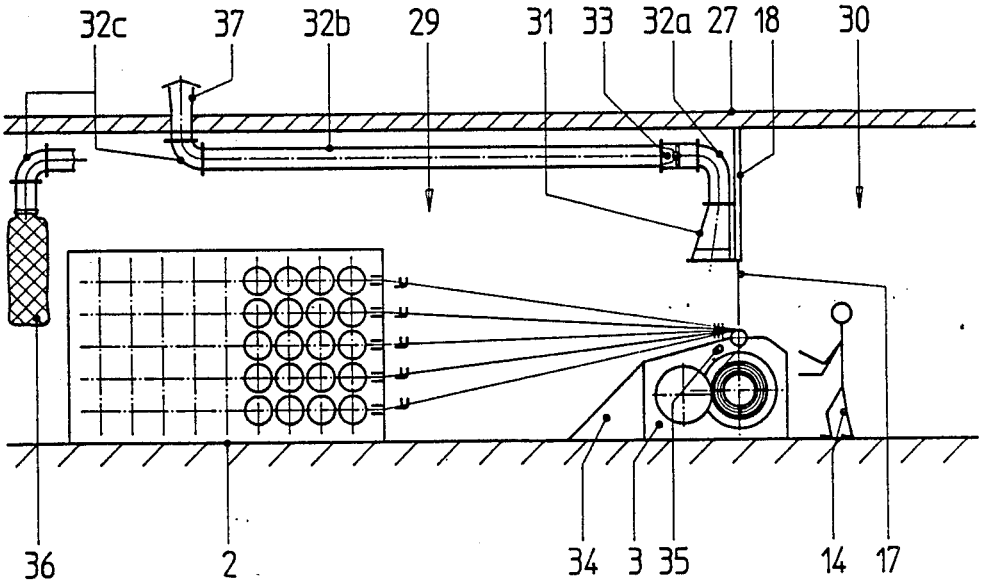
FIG. 2 is a view in cross-section through a winding installation with a protective apparatus incorporating the invention.
Figure 3:
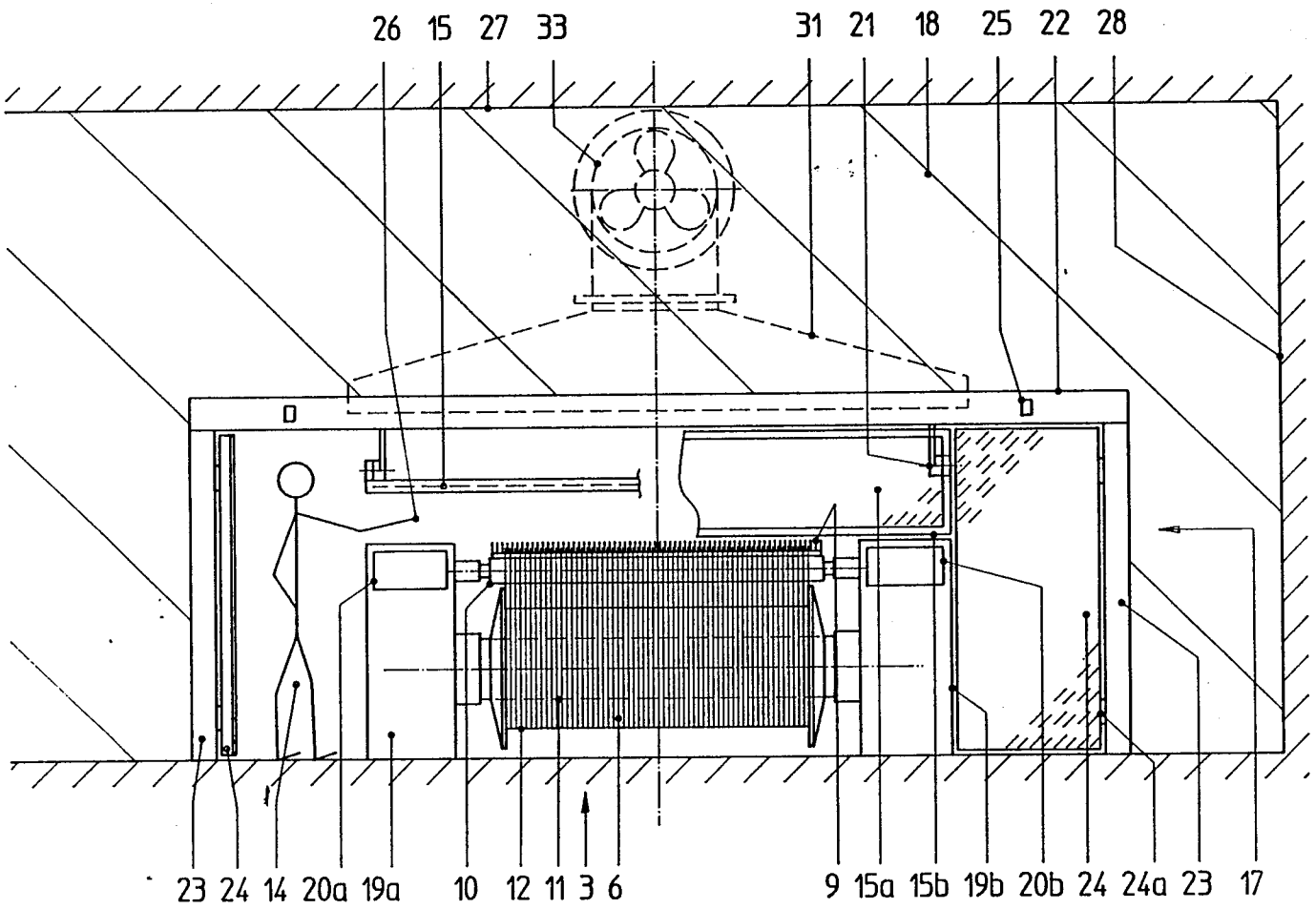
FIG. 3 is a front view on a somewhat enlarged scale of the protective apparatus shown in FIG. 2.

The winding installation shown in FIG. 2 is of substantially the same construction as that shown in FIG. 1 so that there is no need to describe the known parts of the machine again. However the structure and arrangement of the protective apparatus embodying the invention are shown in FIGS. 2 and 3.

A portal-like support construction substantially comprises the two vertical pillars 23 and the transverse support member 22 which rests thereon. That may be for example a welded steel construction. As shown the support construction is substantially greater in respect of width and height than the warping machine 3 which is disposed therebeneath. The two pillars 23 are preferably arranged in such a way that they are disposed approximately in the plane of the central axis of the warping beam 11. Arranged on the support construction are wall portions in the form of an anti-draft plate 15 and two doors 24 which fill the space between the machine and the portal assembly. The wall portions together form a portal wall 17 which closes off the machine room at the creel side, from the operator 14. The support construction with the portal wall 17 may be integrated into a wall 18 of the building so that the support construction only leaves free the cross-section that is absolutely necessary for attending to the machine.

Drive elements, bearings etc (not shown) are installed in the two head portions 19*a* and 19*b* of the warping machine 3. The bearings carry for example the warping beam 11 with the winding 12, and the measuring roller 10. The latter detects the length which has been wound onto the beam and automatically stops the warping machine when the desired winding or warping length is reached.

The warping comb 9 which, as already mentioned, imparts the appropriate ordering effect to the yarns 6 is also supported in the two machine head portions 19*a* and 19*b*. The warping machine is provided with a comb blow-off means 35. The means 35 comprises an air pipe which extends along the comb 9 and which has outlet openings. The fibre particles which accumulate at the comb are blown off by the means 35. The pipe is arranged in such a way that the particles are blown upwardly into the air current produced by the array of yarns 6.

Disposed just above the two head portions 19*a* and 19*b* of the machine and over the warping comb 9 is the pivotable anti-draft plate 15 comprising the plate 15*a* and a frame 15*b*. The anti-draft plate 15 is mounted in mountings 21 which are secured to the transverse support member 22.

Hinges 24*a* for the two swing doors 24 are arranged on the pillars 23. In FIG. 3 the swing door 24 on the right-hand side is shown in the closed position, in which connection it will be seen that the left-hand edge of the swing door closely adjoins the adjacent edge of the right-hand machine head portion 19*b* and the frame 15*b* of the anti-draft plate. On the left-hand side in FIG. 3, both the swing door 24 and the anti-draft plate 15 are shown in the open position. It will be seen in that connection that formed above the machine head portion 19*a* is a free passage 26 which, when the door 24 is open, is freely accessible, including from the side. In that way the winding machine 3 is readily accessible from all sides for preparation and maintenance operations and for working in the yarn area.

Both the anti-draft plate 15 and also the doors 24 are actuable by drive means (not shown in greater detail herein). The drive means may be for example in the form of pneumatic cylinders. The drive means are operatively connected to the warping machine 3 in such a way that they can be activated when the machine stops and starts. When the installation starts up, the anti-draft plate and the doors are moved into the closed position while in the event of intentional or unintentional stoppage of the machine, the doors and/or the anti-draft plate are automatically opened. The level of operating comfort is considerably improved in that way. Photoelectric cells 25 may be arranged in the region of the doors, for example on the transverse support member 22, the photoelectric cells 25 activating the drive means for the doors when an operator approaches. In that way it is easily possible for a person to pass into the machine room at the creel side, even when the machine is running.

Arranged above the winding machine or above the support construction is an extractor hood 31 which is open towards the winding machine. The extractor hood extends practically over the entire width of the machine and is connected to a fan 33 by means of which air can be sucked over the machine. By way of connections 32*a*, 32*b* and 32*c* and by way of a flue 37, the dust-bearing air which is sucked in, in that way, can be discharged to the atmosphere or can be supplied to a diagrammatically illustrated filter installation 36. The extractor hood 31 may be entirely or partly supported on the transverse support member 22.

In order to prevent turbulent air flows and congestion from occurring and in order to improve the effect of the extractor hood 31, the winding machine 3 may be cowled with guide covers 34, as can be seen from FIG. 2. In that way, the arrangement produces a substantially turbulence-free flow from the bobbin creel 2 in an arcuate configuration upwardly towards the extractor hood 31. In that way optimum conditions are provided also in the creel region 29, in that particles of dust and dirt find it practically impossible to be deposited.

It will be seen that total separation of the creel region 29 from the machine region 30 provides optimum operating conditions, free of draft and dust pollution. Even if the operator 14 stands directly in front of an operating panel 20*a* or 20*b*, no draft can be felt. The practically hermetic closure effect achieved by means of the portal wall or by means of the additional wall 18, relative to the ceiling 27 and the side wall 28 of the building, also has a sound-barrier effect. It will be appreciated that the support construction itself can also be of such a configuration that it directly adjoins the ceiling 27 and the side walls 28 respectively.

Besides the anti-draft plate 15 and the swing doors 24, further, for example fixed wall portions may also be arranged in the support construction. Thus for example a fixed skylight could extend above the swing doors 24 and the anti-draft plate 15, over the entire length of the transverse support member 22.

We claim:

1. A winding installation comprising a bobbin creel, a winding machine including a beam for winding on an array of yarns applied from said bobbin creel and a portal-like support construction mounted outside said bobbin creel and over said winding machine with clearance, said support construction extending with respect to width and height beyond said winding machine and substantially parallel to the axis of said beam and said support construction including wall portions that substantially close off said clearance between said support construction and said winding machine thereby giving protection when said winding machine is in operation from draft and dust arising as a result of said operation.

2. An installation according to claim 1, in which said wall portions include an anti-draft plate pivotally mounted on said support construction on an axis parallel to the axis of said beam and arranged for movement between operative and idle positions.

3. An installation according to claim 1, including a partitioning wall in a building on one side of which partitioning wall said bobbin creel is located, said support construction being positively integrated in said partitioning wall.

4. An installation according to claim 1, in which at least some of said wall portions are movable.

5. An installation according to claim 4 in which said movable wall portions are arranged for opening and closing off said clearance between said support construction and said winding machine, the installation further including drive means for moving said movable wall portions between opening and closing positions and sensing means responsive to the starting and stopping of said winding machine for controlling said drive means to move said movable wall portions to the closing position when the winding machine starts and to the opening position when the winding machine stops.

6. An installation according to claim 5, in which one of said movable wall portions is a door and said installation further includes a sensor device mounted to detect the approach of a person towards said door, said sensor device being connected to said drive means and operative to control said drive means for opening said door on the approach of a person.

7. An installation according to claim 6, in which said sensor device is a photoelectric cell mounted on said support construction.

8. An installation according to claim 1, in which said wall portions included at least one door mounted on said support construction on one side of said winding machine.

9. An installation according to claim 8, in which said door is a swing door including a transparent portion.

10. An installation according to claim 1, including an extractor hood open towards said winding machine and mounted above said support construction on the side thereof towards said bobbin creel, a suction apparatus and means connecting said extractor hood to said suction apparatus whereby dust can be sucked away from the vicinity of said winding machine during its operation.

11. An installation according to claim 10, including an air guide cover means mounted on said winding machine towards said bobbin creel and formed for substantially reducing turbulent air flow towards said winding machine when the installation is in operation.

12. An installation according to claim 10, in which said winding machine includes a comb for guiding an array of yarn in an ordered fashion towards said beam when the installation is in operation, the installation further including a comb blow-off means formed with openings located to direct air passing therethrough onto fibre particles collected on said comb to carry the particles to the suction effect of said extractor hood and suction apparatus.

* * * * *